United States Patent [19]

Stewart et al.

[11] 4,182,245

[45] Jan. 8, 1980

[54] METHOD AND APPARATUS FOR THE COMBUSTION OF CRUSHED SOLID FUELS

[75] Inventors: Alan G. Stewart; John Whiteford; William J. Emmett, all of Armadale, Australia

[73] Assignee: Concrete Industries (Monier) Limited, Belmont, Australia

[21] Appl. No.: 887,413

[22] Filed: Mar. 15, 1978

Related U.S. Application Data

[63] Continuation of Ser. No. 722,760, Sep. 13, 1976, abandoned.

[30] Foreign Application Priority Data

Sep. 17, 1975 [AU] Australia ..... 3207
Mar. 29, 1976 [AU] Australia ..... 12453

[51] Int. Cl.[2] ..... F23K 3/02

[52] U.S. Cl. ..... 110/101 CF; 110/104 R; 110/106; 406/122

[58] Field of Search ..... 110/101 R, 101 CF, 104 R, 110/105, 106, 232; 432/22, 36, 51, 58; 302/25, 26

[56] References Cited

U.S. PATENT DOCUMENTS

| | | | |
|---|---|---|---|
| 1,289,144 | 12/1918 | Flanegin | 302/25 |
| 1,559,220 | 10/1925 | Caracristi | 110/106 |
| 1,608,699 | 11/1926 | Kreisinger et al. | 110/106 |
| 1,898,086 | 2/1933 | Frisch | 110/106 |
| 1,943,780 | 1/1934 | Allen | 302/25 |
| 2,158,673 | 5/1939 | Carter et al. | 110/106 |
| 2,259,967 | 10/1941 | Vogel-Jorgensen | 110/106 |
| 2,500,271 | 3/1950 | Bozich | 302/25 |
| 2,716,002 | 8/1955 | Craig | 110/106 |
| 2,839,253 | 6/1958 | Yellott | 110/106 |
| 2,916,217 | 12/1959 | Yellott | 110/106 |
| 3,380,780 | 4/1968 | Allen et al. | 302/26 |
| 3,512,841 | 5/1970 | Kollasch et al. | 302/25 |
| 3,969,068 | 7/1976 | Miller et al. | 110/106 |
| 4,041,906 | 8/1977 | Edwards | 110/106 |
| 4,092,094 | 5/1978 | Lingl, Jr. | 432/1 |

*Primary Examiner*—Henry C. Yuen
*Attorney, Agent, or Firm*—Haseltine, Lake & Waters

[57] ABSTRACT

A method for the combustion of crushed solid fuel comprising crushing the fuel into a powder form, placing the crushed fuel into a storage bin and fluidizing the fuel within the bin, passing the fluid fuel through a de-airing pipe to partially compact the fuel, advancing the partially compacted fuel into a mixing chamber, passing regular pulses of compressed air through the mixing chamber so as to form a vena contracta in the mixing chamber thereby inducing the flow of partially compacted fuel into the compressed air and causing the mixture of fuel and compressed air to flow into a kiln or furnace.

6 Claims, 4 Drawing Figures

METHOD AND APPARATUS FOR THE COMBUSTION OF CRUSHED SOLID FUELS

This application is a continuation of our Application Ser. No. 722760 filed Sept. 13th, 1976, now abandoned.

FIELD OF THE INVENTION

This invention relates to an improved method for the combustion of crushed solid fuels and in particular it relates to the combustion of coal in kilns.

PRIOR ART

Hithertofore the use of coal in the firing of brick kilns has been relatively limited with its major use residing in systems wherein the coal is trickle fed, hand fed, mechanical or air conveyed by systems such as Gibbons Octopus and Impactapus or introduced into the kiln in various other ways. For example, the Octopus system resides in a system wherein milled coal is fed to a distribution point mounted on top of a kiln. The distribution point has consisted of a fan mounted horizontally on a small portable chassis. The fan has a circular casing with radial outlets spaced around its circumference. Flexible tubes connect these outlets to lances which inject the air/coal mixture into the kiln, where the coal burns in suspension. With this particular method and apparatus several disadvantages become apparent when the system is in use. The temperature within a kiln varies from one point to another and accordingly there must be some method of injecting extra fuel into the cooler areas of the kiln to raise the temperature. Similarly it would be advantageous to be able to completely control the rate of feed for each individual lance and if necessary to be able to shut-off any particular lance.

SUMMARY OF THE INVENTION

It is an object of this invention to provide an improved method of supplying coal to a kiln wherein the above mentioned disadvantages are eliminated. In particular the invention will be described for use in continuous Hoffman type kilns, however, it will be appreciated that it can also be applied to car-tunnel kilns and periodic kilns.

In one form the invention resides in a method for the combustion of crushed solid fuel comprising crushing the fuel into a powder form, placing the crushed fuel into a storage bin and fluidizing said fuel within said bin, linking the fluidized fuel with a mixing chamber, passing compressed air through the mixing chamber so as to form a vena contracta so causing the fuel to flow into the compressed air stream and thence into a kiln.

Preferably, a control device is attached to the compressed air line to enable the air pressure to be controlled.

The invention contemplates an apparatus for carrying out the combustion of crushed solid fuel comprising a bin of finely powdered fluidized solid fuel being connected to a mixing chamber so as to create a vena contracta and subsequent flow of fuel being mixed with compressed air, the air/fuel mixture being fed into a kiln, control of flow of compressed air being governed by a solenoid valve or similar unit operated by a pre-set controlling device.

Preferably, every fuel inlet point on a kiln is fitted with separate solenoid valve and pre-set control device.

In yet another form, the invention resides in a method for the combustion of crushed solid fuel comprising temporarily storing said crushed fuel in a fluidized condition in a bin, conveying said fuel by air slide means to a pressure pot, discharging the fuel from the pressure pot into an expansion bin, fuel in a fluidized state then being fed into a trough which is provided with suitable level indicators, de-airing downpipes and the like, said de-airing downpipes resulting in a partial compaction of the fuel within said trough, the partially compacted fuel then being fed into one or more burners, compressed air being passed through said burner to mix with the fluidized fuel, control of compressed air being governed by a solenoid valve or similar unit.

BRIEF DESCRIPTION OF THE DRAWINGS

The embodiments of the invention will be better understood by reference to the following description and accompanying drawings wherein.

DETAILED DESCRIPTION

Figure 1:
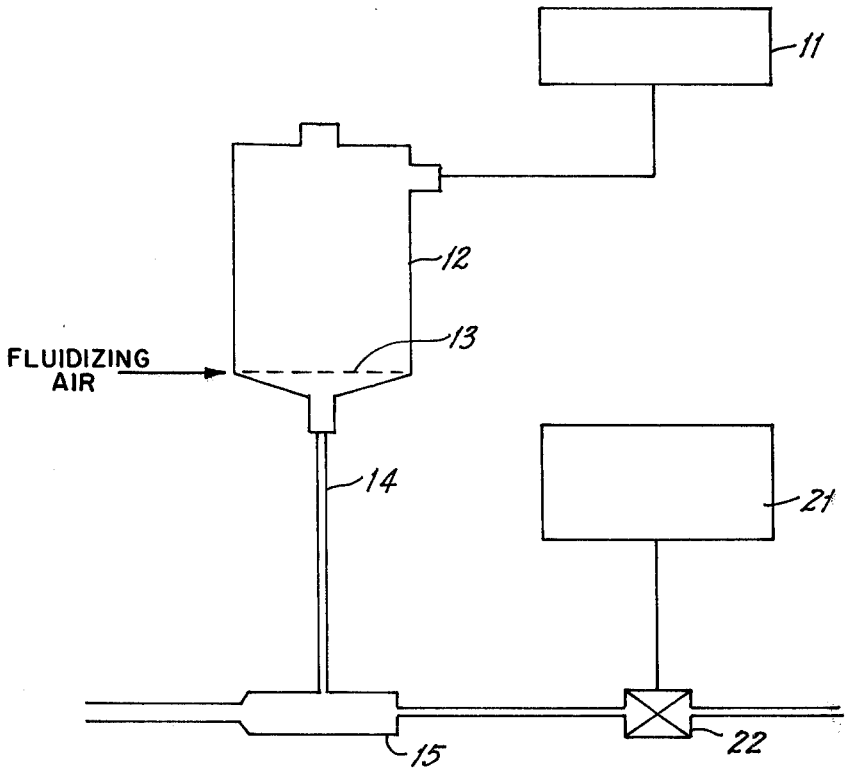
FIG. 1 is a schematic representation of one embodiment.
Figure 4:
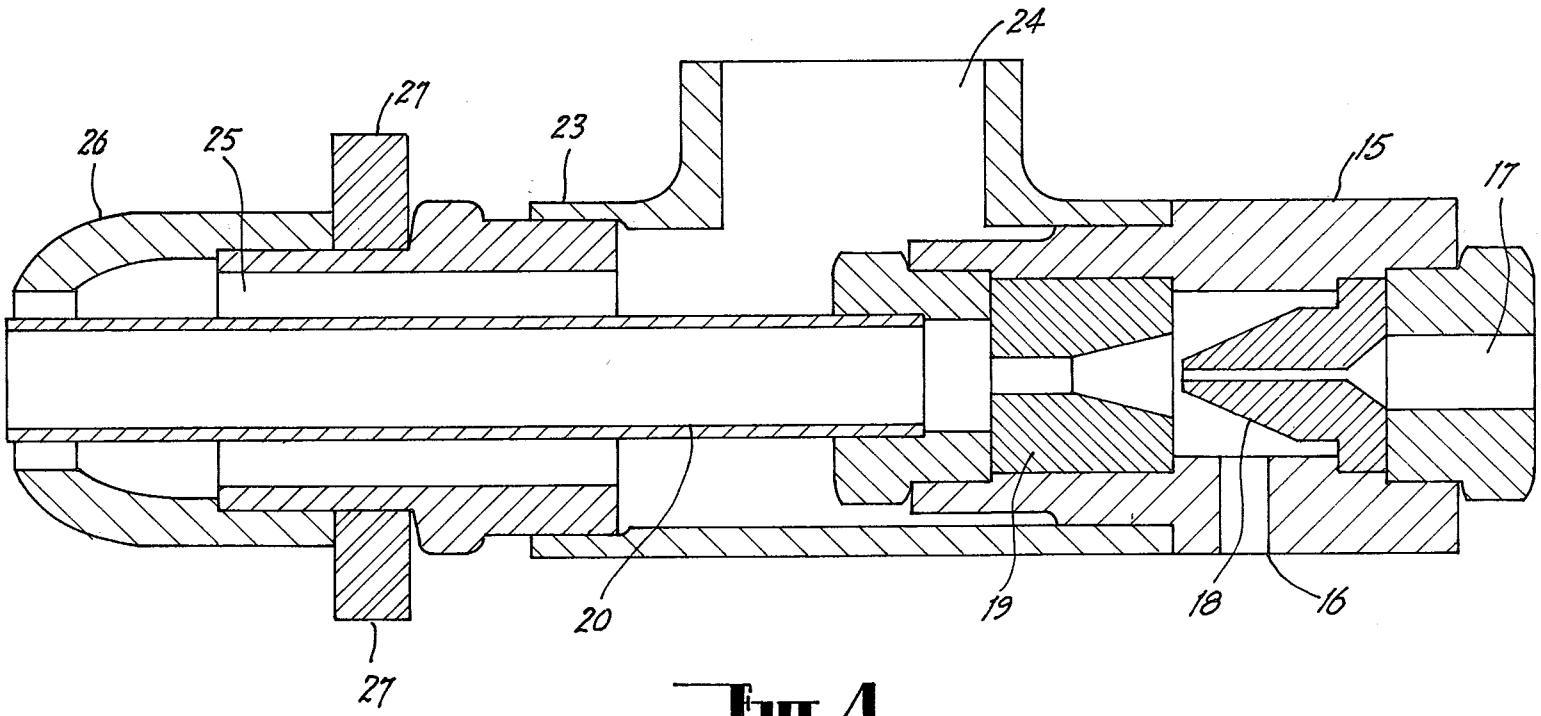
FIG. 4 is a view of the burner shown in FIG. 3 with a surrounding casing fitted to incorporate a secondary air flow.

In the embodiment shown in FIG. 1 of the drawings solid fuel is crushed at 11 by any suitable means and then passed to bin 12 for storage. Generally the bin 12 is provided with vertical walls with the entire base being covered by an aerating pad 13. The pulverized fuel within bin 12 is continuously aerated and maintained in a fluid state. Dry air of approximately 1 p.s.i. is supplied to the aeration pad to maintain the fluidized state of the solid fuel. One or more hoses 14 link the bin 12 with one or more mixing chambers or venturi burners 15. The hose 14 must be electrically conductive such that no static electrical charge can build up. A carbon impregnated rubber, metallic tube or similar materials may be used. The diameter of hose 14 can obviously be varied to suit the specification of the burner 15 and the distance from bin 12 to the burner 15. The size of the hose 14 which has been found most suitable during experimental runs has dimensions of 0.375 inch internal diameter and allows fuel to be conveyed to the burner over distances exceeding 30 feet. Fluidized fuel is passed from hose 14 to fuel inlet 16 of burner 15. Compressed air is fed into the burner 15 through inlet 17 and forced through nozzle 18. Generally compressed air of the order of 20 p.s.i. to 100 p.s.i. has been found most satisfactory. The result is that fuel is caused to flow and mix with the compressed air as it passes through venturi 19 into the blow pipe 20 and into the kiln. The flow of fuel may become erratic depending upon the length of hose 14 and the amount of aeration involved, especially if the compressed air pressure is allowed to fall below 20 p.s.i. A further method of control of the flow of fuel to the burner 15 may be achieved by bleeding air into the suction line/hose 14 so as to increase the air/fuel ratio being introduced into the burner. The flow of fuel through burner 15 is varied by means of pulsing the compressed air flow by use of an automatic electronic timer 21 operating through a solenoid valve 22 or similar such device or combination of devices. The electronic timer 21 may be set from 1 second to 3 minutes "ON" with 1 second to 3 minutes "OFF". The "ON-OFF" operation occurring alternatively and automatically. The compressed air pressure has little or no effect on the input of the fuel but rather on the ejection path and flow characteristics of the fuel. FIG. 4 of the drawings shows the burner 15 with an additional surrounding casing 23 incorporating a secondary air flow. In order to aid combustion, it may be necessary to introduce a secondary air flow into the kiln. This can be done by passing air in inlet 24, through chamber 25 which surrounds blow pipe 20 and then out into the kiln. The leading end of the burner 15 is provided with a protective cap 26 and mounting flange 27, flange 27 being provided to enable the burner to be fitted to a kiln.

Figure 2:
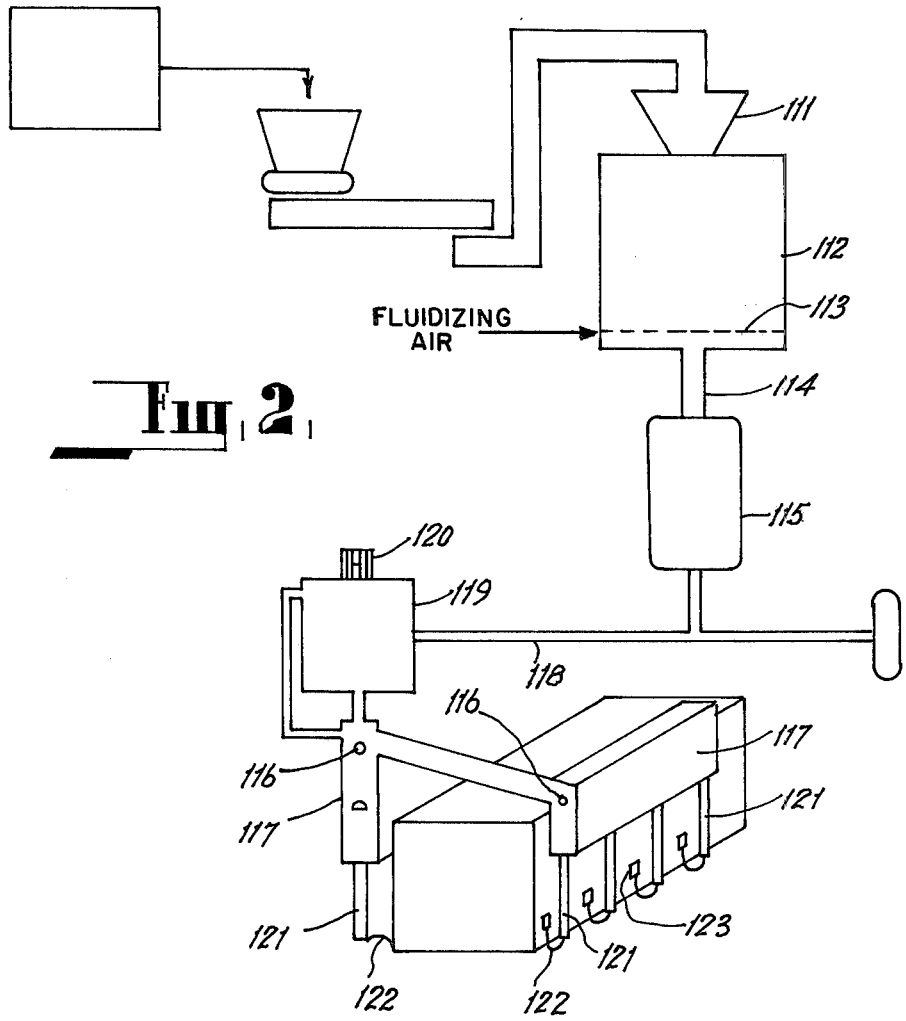
FIG. 2 is a schematic representation of a further embodiment.
Figure 3:
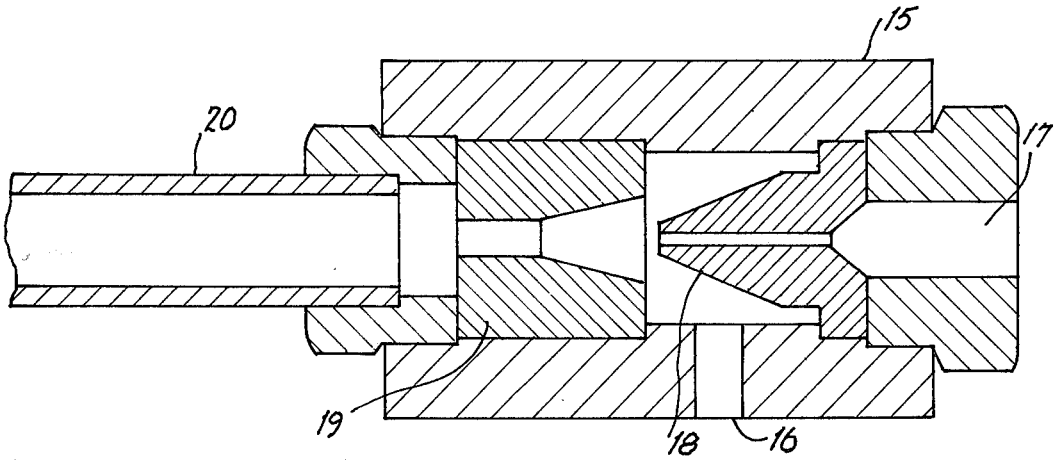
FIG. 3 is a sectional side elevation of the burner.

In the second embodiment shown in FIG. 2 of the drawings an additional flow diagram has been included showing the passage of moist fuel before fluidization. The raw fuel, if too wet to be fluidized, must be suitable dried by using a hollow flight screw conveyor or by under cover air drying or by rotary kiln or similar commercially available equipment. The dry solid fuel is then fed into a crusher 111 and the resultant crushed fuel passed through a sieve into storage bin 112. The crushed fuel generally used must be capable of passing through a size 14 B.S.S. mesh (British Standard Sieve) and is generally readily achieved by employing a hammer mill with screen bars set at 1/16" gap. Other types of mills that can be used quite satisfactorily include fine rolls, rod and ball mills, gyratory crushers, pan mills and the like. If obtainable, dry powdered fuel from separation processes such as wet washing, scrubbing, electrostatic precipitation, bag filters and cyclones may also be used. Generally the storage bin 112 is provided with vertical walls and has the entire base covered by an aerating pad 113. The pulverized fuel within the storage bin is continuously aerated and maintained in a fluid state. The storage bin 112 is linked by way of air slide 114 and pneumatic gate control to a pressure pot 115. On receiving a signal from a level switch 116 situated in the fluidized distributor trough 117, the pressure pot 115 fills and charges a predetermined measure of fuel along discharge line 118 to an expansion hopper 119 located at the appropriate furnace or kiln. The discharge line 118 may be up to 1,000 feet or more in length and is dependent mainly on the pressure and volume of air used for propulsion. The expansion hopper 119 receives the charge of fuel, allows the air (i.e. conveying medium) to escape via a filter 120 of the continuous reverse air jet type or similar. The expansion hopper also allows the received fuel to feed into a distributor trough system 117. If necessary the expansion hopper may be fitted with gate valves, outlets, air bypass lines and/or such devices as are necessary to allow for multiple trough system to operate. Discharge from the expansion hopper occurs simultaneously with the charge of fuel into the expansion hopper from line 118. The fuel in the distributor trough 117 is maintained in a fluid state and at such a level to provide an upper air space undisrupted throughout the trough system. A plurality of de-airing down pipes 121 are provided in the base of trough 117. The de-airing pipes allow partial compaction of the fuel prior to it entering hose 122 and burner 123. If the de-airing pipes are deleted and the hoses 122 connected directly to trough 117, where the trough is above the burner 123, then flow of pulverized fuel will occur down hose 122 and through the burner 123 rendering the system inoperable. The use and operation of the venturi burner, hose, electronic timer and solenoid valve are exactly the same as described above with reference to FIG. 1 of the drawings.

With this method of firing kilns, large savings can be made in the actual cost of fuel consumed.

While the invention has been described with reference to one specific embodiment it is not limited thereto as the system may also be fitted to tunnel kilns with either top or side firing, or to periodic kilns or to types of furnaces other than brick kilns.

We claim:

1. A method for the combustion of crushed solid fuel comprising crushing the fuel into a powder form, placing the crushed fuel into a storage bin and fluidizing said fuel within said bin, passing the fluid fuel through a de-airing pipe to partially compact the fuel, advancing the partially compacted de-aired fuel into a mixing chamber, passing a flow of constantly pulsing compressed air through the mixing chamber so as to form a vena-contracta in said mixing chamber thereby inducing the flow of partially compacted de-aired fuel into the compressed air and causing the mixture of de-aired fuel and compressed air to flow into a kiln or furnace, the combination of the pulsed air flow and the feed of the partially compacted de-aired fuel thereinto from the de-airing pipe being effective to insure regular flow of the de-aired fuel through the de-airing pipe to said mixing chamber and regular pulses of compressed air and de-aired fuel through the vena contracta to the kiln or furnace.

2. A method for the combustion of crushed solid fuel as claimed in claim 1 comprising controlling the flow of compressed air to said mixing chamber by a solenoid valve, and operating said solenoid valve by a pre-set controlling device.

3. A method for the combustion of crushed solid fuel as claimed in claim 1 wherein the compressed air is at 20 to 100 p.s.i.

4. A method for the combustion of crushed solid fuel as claimed in claim 1 wherein said compressed air is discharged into said mixing chamber through a nozzle and then into a venturi forming said vena contracta, the fuel being supplied to the compressed air at said vena contracta.

5. A method for the combustion of crushed solid fuel as claimed in claim 1 wherein said fuel is crushed to a size capable of passing through a 14 B.S.S. Mesh or Sieve.

6. A method for the combustion of crushed solid fuel as claimed in claim 1 wherein the partially compacted fuel is passed to said mixing chamber through an electrically conductive pipe.

* * * * *